US005236308A

United States Patent [19]

Czeratzki

[11] Patent Number: 5,236,308

[45] Date of Patent: Aug. 17, 1993

[54] ROTOR BLADE FASTENING ARRANGEMENT

[75] Inventor: Andreas Czeratzki, Lengnau, Switzerland

[73] Assignee: Asea Brown Boveri Ltd., Baden, Switzerland

[21] Appl. No.: 900,921

[22] Filed: Jun. 18, 1992

[30] Foreign Application Priority Data

Jun. 18, 1991 [CH] Switzerland ..... 1925/91

[51] Int. Cl.[5] ..... F01D 5/30

[52] U.S. Cl. ..... 416/215; 416/500

[58] Field of Search ..... 416/215, 216, 218, 500, 416/198 R, 198 A; 415/119

[56] References Cited

U.S. PATENT DOCUMENTS

| | | | |
|---|---|---|---|
| 888,500 | 5/1908 | Hissink | 416/215 |
| 1,466,324 | 8/1923 | Wilkinson | 416/215 |
| 2,295,012 | 9/1942 | Semar | 416/215 |
| 2,327,839 | 8/1943 | Zschokke | 416/215 |
| 3,475,108 | 10/1969 | Zickuhr | 416/223 A |

FOREIGN PATENT DOCUMENTS

| | | | |
|---|---|---|---|
| 570754 | of 1933 | Fed. Rep. of Germany | 416/215 |
| 0691800 | 5/1940 | Fed. Rep. of Germany . | |
| 110220 | 4/1944 | Sweden | 416/215 |

*Primary Examiner*—John T. Kwon

*Attorney, Agent, or Firm*—Oblon, Spivak, McClelland, Maier & Neustadt

[57] ABSTRACT

In a rotor blade fastening arrangement in the drum rotor of an axial flow turbomachine, the blades are fastened by means of their roots in rows in peripheral blade grooves with support indentations at the side. The blade groove provided for the first blade row is an L groove with two vertical support surfaces and one horizontal support indentation. The blade root engaging in it consists of a vertical protrusion and only one horizontal protrusion to the side.

4 Claims, 1 Drawing Sheet

ROTOR BLADE FASTENING ARRANGEMENT

BACKGROUND OF THE INVENTION

1. Field of the Invention

The invention concerns a rotor blade fastening arrangement in the drum rotor of an axial flow turbomachine, in which the roots of the blades are fastened in rows in peripheral blade grooves with support indentations at the side.

2. Discussion of Background

Such blade fastening arrangements are usually found in compressor and turbine rotors. During each rotation of the rotor, the peripheral blade grooves alter their axial dimension due to rotor bending and due to the amplitude of the bending vibrations. The dimensional change takes place with an amplitude which depends on the particular design. If the amplitude exceeds a certain magnitude, damage due to frictional fatigue can occur on the blade roots or on the turned recesses of the rotor. The corresponding parts of the first turbomachine stage in multi-stage machines are particularly endangered because there is no mutual relief provided by adjacent blade grooves. In consequence, noticeably larger relative displacement amplitudes occur in this first blade groove compared with those in the subsequent blade grooves. This matter is explained in FIGS. 2 and 3 which are described later.

In addition, strongly asymmetrical displacements occur in the first blade groove during changes in temperature, on starting, in the case of load change or of operational fluctuations. These displacements lead to excessive local surface pressures in the blade root support indentations of the first rotor row.

Finally, problems with the simultaneous contact and support of all the participating surfaces occur due to manufacturing tolerances in the case of mechanical inverted T root blade fastening arrangements which are loaded by centrifugal forces in the radial direction and by fluid forces in the axial and peripheral directions and in which the forces are transmitted to the rotor via two or more indentations.

SUMMARY OF THE INVENTION

Accordingly, one object of the invention is to avoid all these disadvantages and, in rotors of the type mentioned at the beginning, to propose a measure by means of which the axial displacement and the asymmetrical deformation of the first bladed groove at least is reduced and by means of which there is unambiguous support for the forces.

This is achieved according to the invention because the blade groove provided for the first blade row at least is an L groove with two vertical support surfaces and one horizontal support indentation and because the blade root consists essentially of a vertical protrusion and only one horizontal protrusion to the side.

In addition to the clarity prevailing with respect to the force relationships, the advantage of the invention may be seen in the fact that only the support surfaces of the turned groove recess and the blade root have to be manufactured with the usual accuracy, i.e. fewer surfaces overall than was previously the case.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of an exemplary embodiment of the high pressure rotor of an axial flow steam turbine, wherein.

DESCRIPTION OF THE PREFERRED EMBODIMENTS

Figure 1:
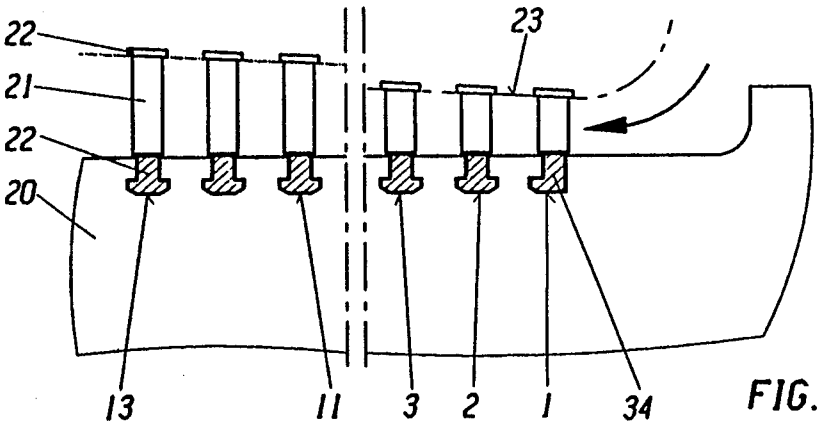
FIG. 1 shows a partially sectioned partial view of a bladed drum rotor.

Referring now to the drawings—wherein like reference numerals or letters designate identical or corresponding parts throughout the several views, where only the elements essential to understanding the invention are shown (not shown, for example, are any of the non-rotating parts of the installation and the shaft ends and bearings) and where the flow direction of the working medium of the gas flow path is indicated by an arrow—the high pressure rotor 20 shown in FIG. 1 is provided with thirteen rotor rows. The individual blades, consisting of blade aerofoil 21 with shroud, plate 22 and blade root 23, are inserted in axially spaced peripheral blade grooves which are numbered from 1 to 13 from the steam inlet end to the steam outlet end. The contour 23 of the cylinder (not shown) forming the flow boundary is shown chain-dotted. The cylinder similarly carries thirteen rows of nozzle guide vanes. The blade roots 23 are of inverted T shape. The centrifugal forces and bending moments acting on the blade in operation are fed into the rotor by means of shoulders via correspondingly configured support indentations of the blade groove.

Figure 2:
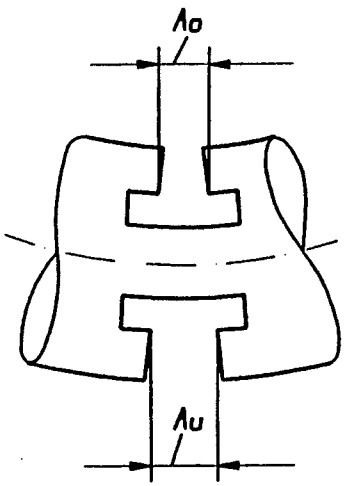
FIG. 2 shows, greatly exaggerated for clarity, the dimensional change, mentioned at the beginning, of a peripheral groove during rotor bending.

The deformation of the blade groove is shown in FIG. 2 by means of a rotor excerpt. The dimensions Ao and Au are taken at the transition between the vertical and horizontal side wall of the turned recess. This transition is located opposite to the position of the inverted T subject to the highest stresses, for which reason the vertical and horizontal parts of the blade root are generally provided with a radius.

Figure 3:
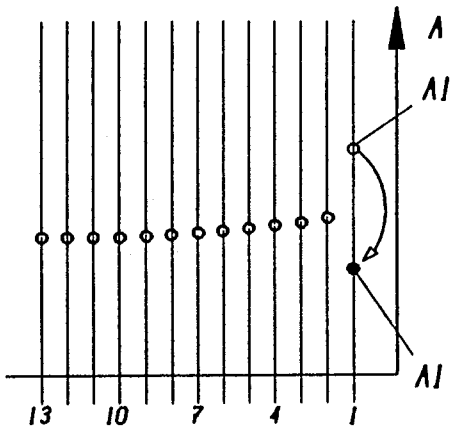
FIG. 3 is a diagram which shows the magnitude of the resulting bending amplitude in the respective blade grooves.

The amplitude A1 is given in FIG. 3 as the arithmetic average of the two distances Ao and Au for each of the thirteen blade grooves. If no counter-measures are taken the value A1 of the axial displacement of the first or upstreammost blade groove is substantially higher than those of the adjacent blade grooves.

Figure 4:
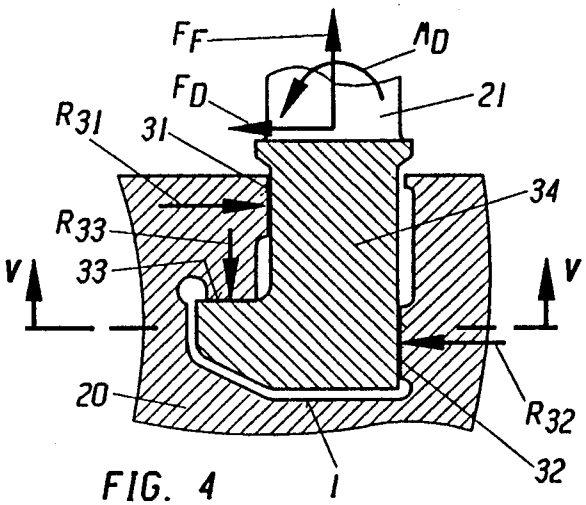
FIG. 4 shows a partial longitudinal section through a blade groove according to the invention.

The invention is applied at this point. It consists in forming the turned groove recess and the blade root essentially in an L-shape. As shown in FIG. 4, the blade groove 1 is formed with two vertical support surfaces 31 and 32 respectively and one horizontal support indentation 33. The support surface 31 finishes flush with the rotor surface; the support surface 32 is located in the region of the bottom of the groove and forms an undercut. The blade root 34 consists of a vertical protrusion and a horizontal protrusion to the side. In operation, its vertical boundaries are in contact with the support surfaces 31 and 32 and the horizontal part of its side protrusion is in contact with the support indentation 33.

Figure 5:
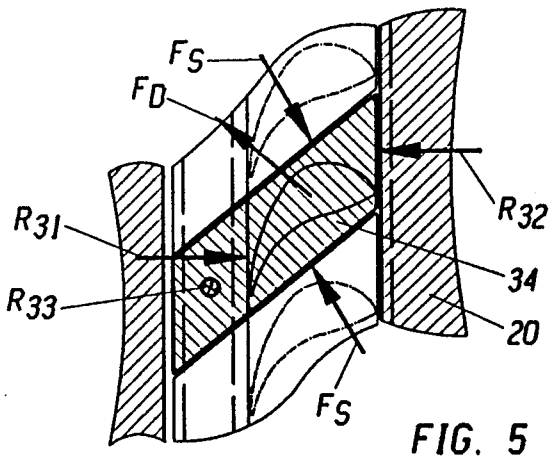
FIG. 5 shows a diagrammatic sketch using a partial development of a cylindrical section along the line V—V in FIG. 4.

The forces acting on the blade fastening arrangements, which may be seen from FIG. 4 and 5, consist in the simplest case of the radially acting centrifugal force $F_F$ and the steam pressure $F_D$ acting on the blade aerofoil. The latter determines the bending moment $M_D$. The bending moment $M_D$ is also affected by the fact that the centres of gravity of the supporting cross-sections are not located in the line of action of the centrifugal forces. The steam forces are introduced into the rotor via the axial surfaces 31 and 32 and, in the peripheral direction, via the mutual support of the adjacent blade roots. The forces exerted by the adjacent blade roots on the blade root considered are indicated by $F_S$. Their axial components are similarly introduced into the rotor via the axial surfaces 31 and 32.

The corresponding reaction forces exerted by the walls of the groove are indicated by $R_{31}$, $R_{32}$ and $R_{33}$.

The effect of the new measure can be seen in the diagram of FIG. 3. The relatively large flank motions of amplitude A1 are now reduced to approximately half the magnitude, A1'. Another favorable side effect may be seen in the fact that vibration loads occurring during operation are introduced directly and unambiguously into the rotor via the axial surfaces 31 and 32 and, in fact, with a greatly reduced notch effect compared with conventional inverted T shapes, in which the forces caused by vibrations must first be transferred from the vertical protrusion into the side protrusions.

As a departure from the arrangement shown, the blade grooves and roots of all the blade rows can, of course, be equipped with the new measure. As a guideline, it can be stated that the new fastening arrangement is fundamentally suitable for all highly loaded, high pressure blading in which the fluid forces are more important than the centrifugal forces and, in fact, independent of whether the blades have free-standing or connected blade tips. In addition, the measure is used with advantage in the case of pretwisted blades because here again, it contributes to clarifying the introduction into the rotor of the moments caused by the torsion.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An axial flow turbomachine comprising:

a rotor defining a substantially axial gas flow path from an upstream end of the rotor toward a downstream end of the rotor;

a plurality of axially spaced rows of peripheral blade grooves in said rotor, wherein only an upstreammost one of said grooves is L-shape in section and at least one of remaining ones of said grooves is inverted T-shape in section; and rotor blades fitted in said grooves and having sections complementary to the groove sections in which the respective blades are fitted.

2. The turbomachine of claim 1 wherein all of the remaining ones of said grooves are inverted T-shape in section.

3. The turbomachine of claim 1, wherein said upstreammost one of said grooves has two vertical support surfaces and only one horizontal support surface.

4. The turbomachine of claim 1 wherein one of said vertical support surfaces is flush with the peripheral surface of the rotor and the other of said vertical support surfaces is adjacent a bottom of the groove.

* * * * *

UNITED STATES PATENT AND TRADEMARK OFFICE

CERTIFICATE OF CORRECTION

PATENT NO. : 5,236,308

DATED : August 17, 1993

INVENTOR(S) : Andreas Czeratzki

It is certified that error appears in the above-indentified patent and that said Letters Patent is hereby corrected as shown below:

On the title page, Item [30], should read: --Jun. 28, 1991 [CH] Switzerland.....1925/91--

Signed and Sealed this

Fifteenth Day of March, 1994

*Attest:*

Bruce Lehman

BRUCE LEHMAN

*Attesting Officer*

*Commissioner of Patents and Trademarks*